United States Patent [19]

Storandt

[11] 4,230,337

[45] Oct. 28, 1980

[54] SKI BINDINGS AND SKI BRAKES ASSOCIATED THEREWITH

[75] Inventor: Ralf Storandt, Leonberg, Fed. Rep. of Germany

[73] Assignee: Verrinigte Baubeschlagfabriken Gretsch Co. GmbH, Fed. Rep. of Germany

[21] Appl. No.: 954,128

[22] Filed: Oct. 24, 1978

[30] Foreign Application Priority Data

Dec. 19, 1977 [DE] Fed. Rep. of Germany ..... 2756525

[51] Int. Cl.[3] ..... A63C 7/10

[52] U.S. Cl. ..... 280/605

[58] Field of Search ..... 280/604, 605

[56] References Cited

U.S. PATENT DOCUMENTS

| | | | |
|---|---|---|---|
| 3,940,158 | 2/1976 | Wehrli | 280/605 |
| 3,992,030 | 11/1976 | Salomon | 280/605 |
| 4,103,916 | 8/1978 | Krob et al. | 280/605 |
| 4,108,465 | 8/1978 | Schmidt et al. | 280/605 |

FOREIGN PATENT DOCUMENTS

| | | | |
|---|---|---|---|
| 2513188 | 10/1975 | Fed. Rep. of Germany | 280/605 |

*Primary Examiner*—John J. Love
*Assistant Examiner*—Milton L. Smith

[57] ABSTRACT

A ski brake including at least one brake arm is detachably associated with a ski binding. The brake arm is arranged for movement about a transverse pivot axis defined by pivot axle means located between a base plate of the binding and a heel plate for supporting the heel of the ski boot. The heel plate can be clipped into position on the base plate, with or without the ski brake present, by means of cooperating clip elements on the base plate and heel plate respectively. Three different embodiments are shown including a base plate mounting which allows the ski to flex freely and an arrangement for a ski brake having two transverse pivot axles interconnected by a torsionally loaded actuating loop.

38 Claims, 15 Drawing Figures

Figures 1, 2, 3:
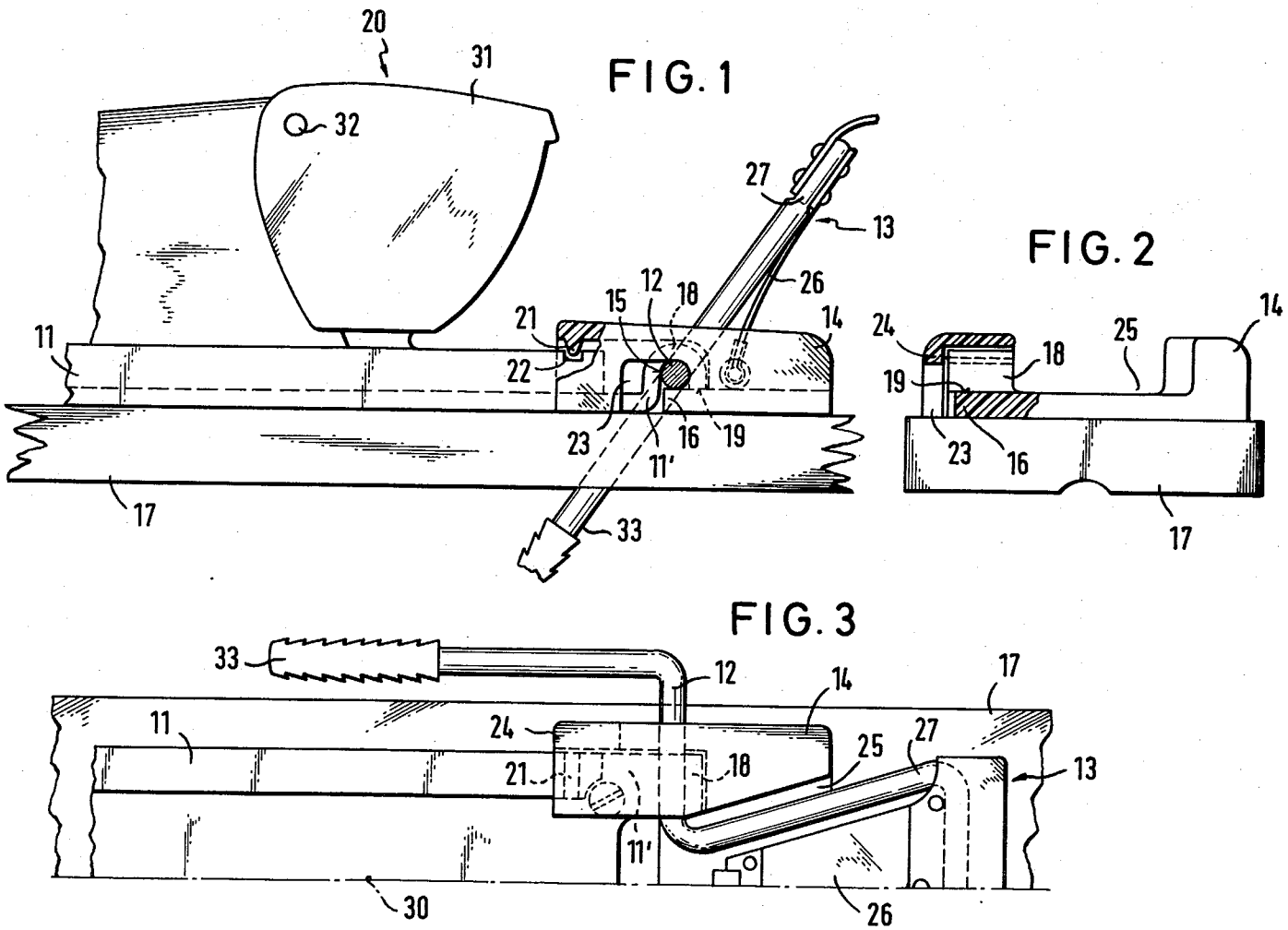

11
11'
12
13
14
15
16
17
18
19
20
21
22
23
24
25
26
27
30
31
32
33

13
14
15a
15b
16
17
18
20
21
22
23
24
11
12a
12b
31
32
33
38

SKI BINDINGS AND SKI BRAKES ASSOCIATED THEREWITH

This invention relates to ski bindings and to ski brakes associated therewith and has particularly reference to a ski brake detachably associated with the base plate of a ski binding and having at least one brake arm pivotally movable about an axis lying parallel to the surface of the ski and transverse to the longitudinal direction of the ski.

Ski brakes detachably arranged on the base plate of a ski binding are known for example from DE-OS No. 2,513,188. Ski brakes of this kind offer the advantage that they can at any time be mounted on (i.e. fitted to) or, as desired, removed from a heel binding which is preferably of the kind capable of allowing a vertical release of a ski boot. In this manner it is possible to retrofit existing heel bindings with ski brakes. It is however disadvantageous that it is first of all necessary to remove the heel plate provided on the binding base plate and to replace it with the complete ski brake assembly. If for example the ski-brake is to be removed for deep snow skiing then it is necessary for the skier always to carry, or to keep on hand, the heel plate which is to replace the ski brake assembly in order to maintain the ski binding in a condition in which it is capable of functioning faultlessly. If the original heel plate which is provided with the binding should become lost it is not possible to use the binding when the ski brake has been removed.

An object of the invention is thus to provide a ski brake detachably fittable to the base plate of a ski binding, which allows the skier to choose whether to ski with a mounted ski brake or with the ski brake removed, without the necessity of carrying a heel plate with him and without the danger that the binding will not function correctly with the ski brake removed. In particular the safety release characteristics of the binding should not be disadvantageously influenced with the ski brake removed.

This object is achieved by the present invention in that in accordance with the invention there is provided a ski brake detachably associated with the base plate of a ski binding and having at least one brake arm, a heel plate connectable to and detachably associated with the base plate by means of cooperating clip elements and means defined by the base plate and the heel plate for supporting the brake arm for pivotal movement about a pivot axis aligned substantially parallel to the upper surface of the ski and transverse to the longitudinal axis thereof.

Thus the heel plate forms a part of the securing mechanism for the ski brake but is however a component separable therefrom which can also be clipped into engagement with the base plate without the ski brake being present. Thus the same heel plate is present for supporting the heel of the ski boot both with a mounted ski brake and when the ski brake is absent. By this means not only is the necessity of continuously having a special heel plate available overcome but, rather, it makes it possible to maintain the frictional conditions between the ski boot and the heel plate constant both with a mounted ski brake and with the ski brake removed because the heel plate used is the same in both cases. A further advantage resides in the fact that the ski brake can be manufactured with considerably less trouble and expense because the heel plate provided with the ski binding to which the ski brake is to be retro-fitted can continue to be used. The heel plate already provided with the binding is not therefore rendered superfluous and, providing it has been constructed at the beginning in accordance with the present invention (which is possible without significant additional manufacturing cost or difficulty), does not need to be thrown away.

As heel plates are predominantly manufactured of a resilient synthetic material, the clipping of the heel plate onto the base plate, is sufficient in order to guarantee that both the heel plate and the ski brake are satisfactorily secured to the base plate without the need for additional fastening elements. The need to provide an additional means of fastening the ski brake to the base plate of the binding by screws or the like thus no longer arises. The heel plate can however also be secured to the base plate by additional spring elements such as for example a leaf spring.

An advantageous embodiment of the invention is constructed so that a recess open at one side is provided in the base plate for the introduction of the axle of the ski brake and the function of securing the axle at the open side of the recess is carried out by a part of the heel plate when the heel plate is clipped into position. The axle of the ski brake can thus be introduced without effort into the open recess and secured in this recess by the heel plate.

The part of the base plate securing the axle of the ski brake can be separately fastened to the ski and be axially displaceable relative to the other parts of the base plate. By this means the relevant part can be displaced by small amounts relative to the other parts of the base plate on bending of the ski without the secure positioning of the heel plate or of the ski brake between the heel plate and the base plate being disadvantageously affected. Furthermore this measure does not result in the removability of the ski brake being disadvantageously affected. The part of the base plate which secures the axle of the ski brake is usefully arranged to have claw like members which secure the axle from above and which are open at their undersides. In this manner it is advantageously arranged that the heel plate has a projection and is capable of being moved along the length of the ski into engagement with the base plate so that the projection is pushed beneath the ski brake, when this is in position, and secures it from below. If in the engaged position the projection is simultaneously adjacent the ends of the claw like members, then a bearing space is formed which encloses the axle of the ski brake from all sides and, with due allowance for the desired amount of play guarantees a faultless support for guiding the axle of the ski brake.

Preferably the heel plate is slid into engagement with the base plate from the end of the base plate away from the binding and is secured in position by means of cooperating clip elements in the form of a sprung latch member engagable with a latch recess on the base plate.

For forming the projection, and to enable it to be engaged with the axis of the ski brake, the heel plate usefully has a cut out of right angled shape extending upwardly from its base. The projection is then formed by the material remaining between the cut out and the base and is engaged with the base plate by inserting the cut out downwardly over the ski brake and sliding it rearwardly to engage the projection beneath the claw like members.

As seen from above the heel plate should preferably have a generally U-shaped form with the legs of the U extending over the axle of the ski brake and along the side edges of the base plate and each carrying a respective latch projection, for engagement with latch recesses in the base plate. The functions of the latch projection and the latch recess can also be interchanged. The heel plate preferably has a depression in its upper surface for accomodating the actuating part of the ski brake so that this part can be located beneath the surface of the heel plate when the ski brake is in its undeployed position.

A further embodiment is characterized in that the base plate is provided with the recess for receiving the ski brake at its end face in front of the binding and the heel plate has side disposed recesses which can snap into engagement on the axle of the ski brake so that the axle is located sideways by parts of the heel plate and not by the base plate. In this embodiment the heel plate to be clipped to the base plate should be given a form such that it is held against sideways displacement, i.e. displacement parallel to the axis of the ski brake, relative to the base plate.

The invention can also be used without difficulty with ski brakes of the kind working on the torsion bar principle. In this case both axles of the ski brake are detachably secured by the heel plate to the base plate.

Figure 4:
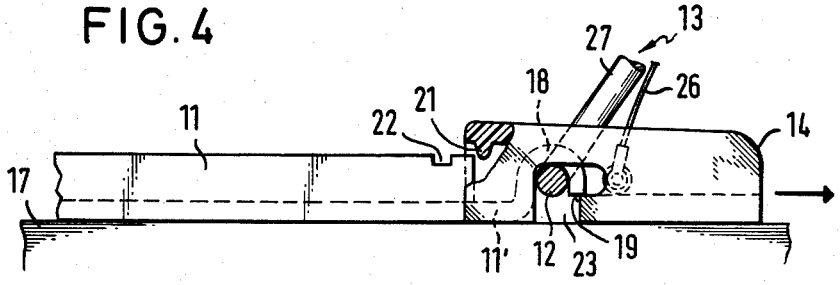
Figure 5:
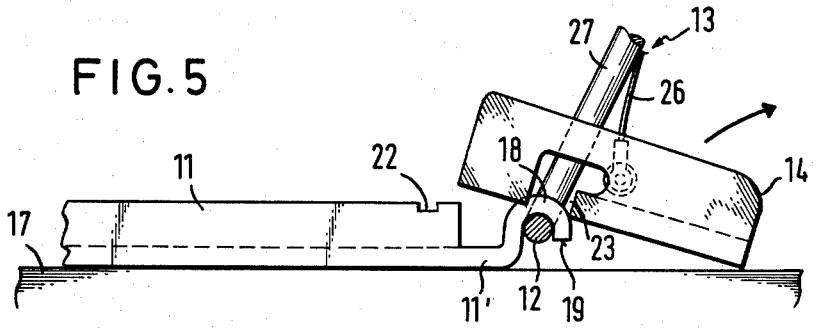
Figure 6:
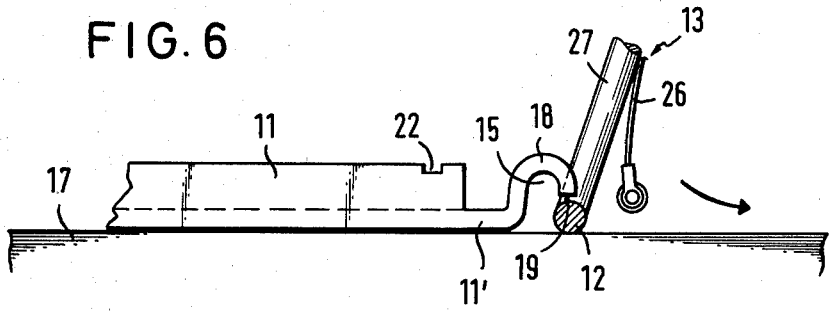
Figure 7:
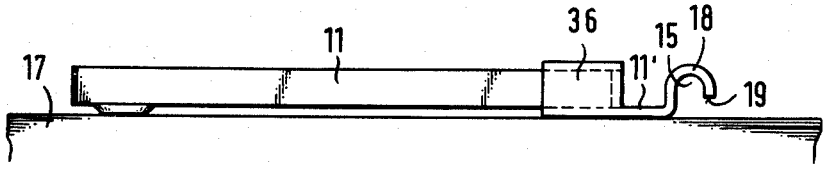
Figure 8:
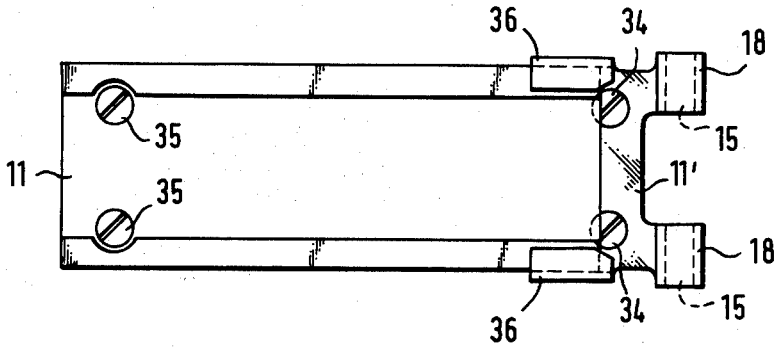
Figure 9:
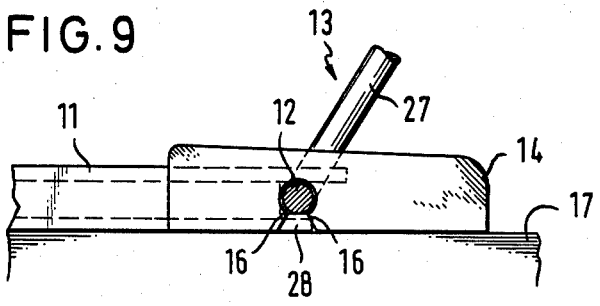
Figure 10:
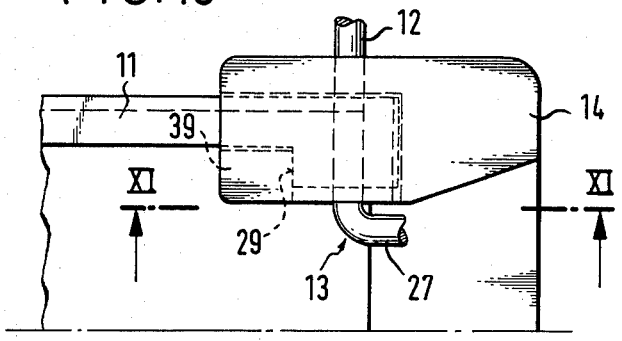
Figure 11:
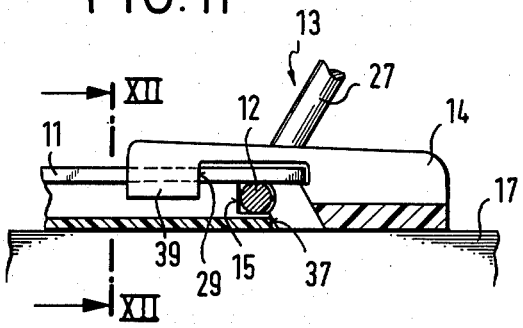
Figure 12:
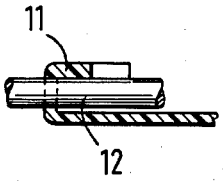
Figures 13, 14, 15:
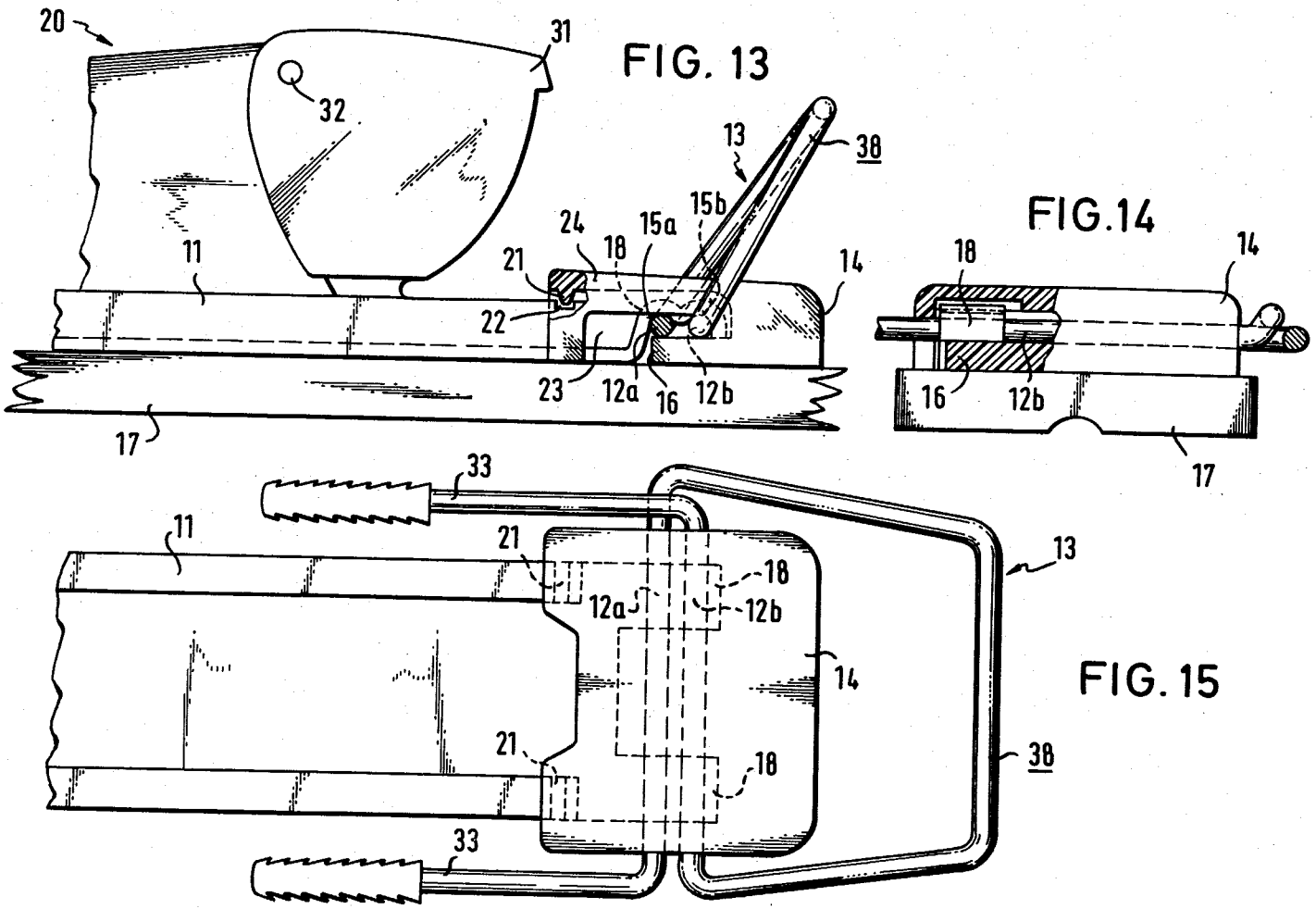

Embodiments of the invention will now be described by way of example only and with reference to the accompanying drawings in which are shown:

FIG. 1 a partly sectioned side view of a ski brake detachably associated with the base plate of a ski safety binding, FIG. 2 a partly sectioned front elevation of the subject of FIG. 1 in which however the ski safety binding is not shown, FIG. 3 a plan view of the subject of FIG. 1, in which the illustration is restricted to a half section, as the other half is of completely symmetrical construction, and in which the ski safety binding has likewise been omitted to simplify the illustration, FIGS. 4 to 6 partially sectioned side elevations similar to FIG. 1 but with the ski safety binding omitted to illustrate the construction of the ski brake, FIG. 7 a side elevation of a base plate constructed in two parts, FIG. 8 a plan view of the subject of FIG. 7, FIG. 9 a partially sectioned side view of a further embodiment of a ski brake fastened to a base plate, FIG. 10 a partial plan view of the subject of FIG. 9, FIG. 11 a section on the line XI—XI of FIG. 10, FIG. 12 a section on the line XII—XII of FIG. 11, FIG. 13 a partially sectioned side view of a ski brake operating on the torsion brake principle, FIG. 14 a partially sectioned front elevation of the subject of FIG. 13, but with ski safety binding omitted and FIG. 15 a plan view of the subject of FIG. 13 likewise with the ski safety binding omitted.

Referring firstly to FIGS. 1 to 3 there is shown the base plate 11 of a ski safety binding 20 which has a heel clamp 31, capable of pivotal movement in an upward direction about the transverse axis 32. The base plate 11 is fastened to a ski 17 in a manner not shown in detail but well-known per se. The base plate 11 of the heel binding 20 projects beyond the lip of the heel clamp 31 and thus extends to the location occupied in operation by the heel of a ski boot (not illustrated in the present drawings). As can also be seen more clearly by referring to FIG.6 two claw like members 18 are provided at the forward end 11' of the base plate 11 and the claws 18 are open at their underside to define recesses 15 which act as bearing recesses for receiving the transverse axle 12 of a ski brake 13. The spacing of the ends 19 of the claws 18 from the upper surface of the ski 17 is chosen to be sufficiently large so that, as can be seen from FIG. 6, the transverse axle 12 of the ski brake can be introduced without effort through the resulting gap.

As seen in FIG. 3 the two claw like members 18 which engage over the pivot axle 12 of the ski brake are arranged spaced apart to either side of the central longitudinal axis 30 of the ski.

A heel plate 14 cooperates with the base plate 11 to detachably secure the ski brake in position. As can be seen from the plan view of FIG. 3 the heel plate 14 has in general the shape of a U in which the cross strap joining the two side legs 24 of the U is disposed away from the heel binding 20, and the two side legs 24 of the U extend over the transverse axle 12 of the ski brake 13 away from the cross strap. At their ends facing the binding 20 the legs 24 are provided with downwardly directed latch projections 21 which cooperate with corresponding latch recesses 22 in the upper surface of the base plate 11. In the vicinity of the transverse axle 12 the side legs 24 of the heel plate 14 have cut outs 23 which extend from the base of the heel plate 14 to approximately the height of the claw like member 18. The recesses are also generally of right angled section so that two projections 16 are formed which, when the heel plate is in the position shown in FIG. 1, engage beneath the transverse axle 12 of the ski brake 13. The projections 16 thus have one side in contact with the surface of the ski and their upper sides contact the ends 19 of the claw like members 18. The projections 16 and the latch projections 21 on the heel plate, together with the ends 19 of the claw like members 18 and the latch recesses 22 on the base plate, form cooperating clip elements which enable the heel plate to be connectably and detachably associated with the base plate. The manner in which the connection and detachment are executed will be later described with reference to FIGS. 4, 5 and 6.

The ski brake 13 comprises two brake arms 33 extending along either side of the ski, the transverse axle 12 which interconnects the brake arms and which passes through the bearing surfaces defined by the claw like members 18, and a generally U-shaped hook like part 27 which is intended to be held in a depressed position by the ski boot so that the brake arms 33 are maintained in their undeployed position alongside the ski. A leaf spring 26 which extends from the hook part 27 of the brake to the heel plate brings about the deployment of the brake arms 33 into their braking position when the ski boot is withdrawn or slides out of engagement with the binding.

The hook part 27 and the spring 26 are in this embodiment arranged to lie in a depression 25 in the heel plate when the ski brake is in the undeployed position. The details of the ski brake are illustrated in the installed condition in FIGS. 1 to 3. In this installed condition the projections 16 which pass beneath the transverse axle 12 complete the bearing support for the transverse axle 12 so that it is completely encircled by the bearing supports at two positions. Thus the projections 16 and the claw like members 18 form means defined between the base plate and the heel plate for supporting the brake arm for pivotal movement about a pivot axis disposed parallel to the upper surface of the ski and transverse to the longitudinal axis thereof. In this engaged position the latch projections 21 are spring biased by resilience of the heel plate into the latch recesses 22 and thus prevent displacement of the heel plate 14 relative to the base plate 11 in the longitudinal direction of the ski. Furthermore the cooperation between the projections 16 and the ends 19 of the claws 18 avoids the heel plate 14 lifting relative to the base plate.

If the skier engages his ski boots with the binding in the open position then the hook part 27 is depressed downwardly into the recess 25 and the brake arms 33 adopt their undeployed position to the sides of the ski 17.

If it is desired to remove the ski brake from the binding then, as can be seen from FIG. 4 the latch projections 21 are lifted out of the latching recesses 22. This can be done either by pushing against the heel plate in the direction shown by the arrow of FIG. 4 and relying on the profile of the latch projections 21 cooperating with the edge of the latch recesses 22 to effect the necessary lifting or, alternatively, by levering the latch projections upwardly and simultaneously pushing in the direction of the arrow. It is then necessary to continue pushing the heel plate 14 forwardly until the transverse axle 12 abuts the rear most limits of the cut outs 23. Once this position has been reached then, as shown in FIG. 5 the heel plate 14 can be lifted in the direction of the arrow away from the ski and base plate. As soon as the heel plate 14 has been removed then as can be seen from FIG. 6 the transverse axle 12 can be dropped downwardly from the claw like members 18 and slid out through the gap between the claw like members 18 and the upper surface of the ski 17.

It is of course entirely possible to substitute some other kind of sprung element for the latch projections 21 for example a leaf spring and to rely on this other sprung element or elements to latch the heel plate into engagement with the base plate 11.

After the ski brake has been removed in the manner described above the heel plate can once more be engaged with the base plate 11. The heel plate is then once more completely capable of functioning in the desired manner to support the heel of the ski boot.

The mounting of the ski brake in position between the base plate and the heel plate can of course be achieved by reversing the sequence of events described above.

It is of especial importance that the heel plate 14 and also the base plate 11 are arranged from the very beginning to allow the possibility of the subsequent retro-fitting or provision of a ski brake 13. This desire can be satisfied for example in the above described manner with relatively trivial manufacturing costs or trouble. In this manner the skier who subsequently decides to fit his binding with a ski brake only needs to buy the actual brake 13 and to build it into the binding in the manner already described in connection with FIGS. 4 and 6. This, of course does not require any readjustment of the setting of the binding.

Turning now to FIGS. 7 and 8 there is shown an alternative embodiment in which a part 11' of the base plate 11 carries the claw like members 18 and is constructed as a separate component from the part 11 and is fastened to the ski by screws 34 independently of the part 11 of the base plate which is fastened to the ski by further set screws 35. As can be seen at the part of FIGS. 7 and 8 referenced 36, the base plate part 11 and the part 11' are however connected together by means of a pair of guides 36 extending in the longitudinal direction of the ski which allow solely a relative movement of the two parts 11 and 11' in the longitudinal direction of the ski. By this arrangement the two parts 11 and 11' of the base plate are on the one hand connected together to properly support the heel binding but, on the other hand, are relatively axially displaceable in the longitudinal direction of the ski in the manner necessary to accommodate bending of the ski during use. In other respects the construction of the embodiment shown in FIGS. 7 and 8 is the same as for the embodiment described with reference to FIGS. 1 to 6.

Turning now to FIGS. 9 to 12 there is shown another possibility by means of which the ski brake 13 can be detachably attached to the base plate 11 by means of a heel plate 14. As seen in FIG. 11 a recess for accommodating the transverse axle of the ski brake is formed in the forward end face 37 of the base plate 11. The boundaries of this recess 15 then locate the transverse axle 12 against displacement upwardly downwardly and rearwardly. In the forward direction the recess 15 is open.

In order to additionally secure the transverse axle 12 against displacement in a forward direction the heel plate 14 is provided with a pair of latching recesses 28 which extend upwardly from the base of the heel plate and which initially taper by a certain amount before opening into a generally circular sectioned recess which suits the diameter of the transverse axle 12 of the ski brake. By this means the heel plate 14 can be pressed onto the transverse axle 12 of the ski brake from above so that the transverse axle 12 is seated in the two generally circular reception chambers formed by the circular section parts of the recess.

The heel plate 14 is also provided at its rearward end with abutments 39 in the form of steps which engage cut out steps 29 or the like provided in the base plate 11 so that as the heel plate 14 is snapped into place the abutments 39 are also engaged with the abutments 29 with the result that the heel plate 14 can no longer be displaced forwardly in the longitudinal direction of the ski. In order to secure the heel plate 14 to the base plate 11 when the ski brake is removed it is necessary to provide further cooperating clip elements on the heel plate and the base plate 11. This is readily achieved by providing a central portion of the heel plate which lies intermediate the two abutments 39 with a rearwardly projecting lip or latch which engages under the front edge of the corresponding part of the base plate 11. This further clipping feature is brought into engagement at the time the heel plate 14 is clipped into position by virtue of the resilience of the heel plate allowing it to snap around the front edge of the base plate 11. The subsequent engagement of the lip under this front edge is prevented from being released, other than by a determined effort applied to the heel plate by the axial alignment maintained through the cooperating pairs of abutments 39 and 29. The heel plate in this embodiment is likewise provided with a recess similar to the recess 25 discussed in connection with the embodiments of FIGS. 1 to 6 so as to accommodate the loop like part 27 of the ski brake in the undeployed position.

Referring now to FIGS. 13 to 15 there can be seen a further exemplary embodiment which in general corresponds to the embodiment of FIGS. 1 to 6 but differs therefrom in that instead of using a ski brake with only a single transverse axle 12 there is used a ski brake having two transverse axles **12*a* and 12*b* which are parallel to each other and are connected together via a torsion bar or torsion wire 38. The ski brake 13 works in accordance with the torsion bar or torsion wire principle known per se for ski brakes. In order to accommodate this alternative form of ski brake the claw like members 18 are each provided with two recesses lying one behind the other along the longitudinal direction of the ski. The projection 16 in the lower region of the heel plate 14 is made correspondingly longer so that it can pass beneath both the transverse axles 12***a* and 12*b*. In similar fashion it is necessary for the cut outs 23 provided in the heel plate 14 to be made correspondingly wider than in the embodiment of FIGS. 1 to 6 so that during mounting or removal of the ski brake the heel plate 14 can be engaged over the two transverse axles 12*a* and 12*b*. As can be seen from FIG. 15 in the undeployed condition the loop-like part 38 of the ski brake passes around the outside of the heel plate 14 rather than lying in a recess formed in the heel plate 14. In the undeployed condition the two side legs 13 of the loop of the ski brake are thus parallel to one another; in contrast in the deployed condition shown in FIG. 13 the two side legs 13 are at an angle to one another and it is the torsional movement induced into the cross leg 38 of the loop by relative movement of the two legs to the undeployed condition which provides the necessary torsional wind-up in the loop to ensure movement of the ski brake to the deployed condition once the boot is removed from the binding. If this force should be insufficient it can be supplemented by ensuring a suitable preload is present in the part 38.

It will be apparent to those skilled in the art that many modifications may be made to the features of the designs herein shown; in particular to the location and arrangements and form of the cooperating clipping elements on the heel plate and the base plate without departing from the spirit of the teaching herein contained. In particular it will be appreciated that while all the above embodiments have been illustrated with respect to a pair of brake arms there is absolutely no difficulty in applying the teaching to a ski brake with a single brake arm. In this case it will likewise be necessary to provide the ski brake and the single brake arm with a transverse pivot axle and this transverse pivot axle can readily be supported in accordance with the embodiments and teaching given above. Furthermore it should be noted that in all of the embodiments shown in the pivot axle of the ski brake is rotated with the brake arm on deployment of the ski brake. It will however of course be appreciated that there is no requirement that the transverse pivot axle rotate as it could e.g. simply be arranged as a fixed axle with the ski brake arm or arms freely pivotally mounted to one or both ends respectively and with a cooperating spring feature to effect the necessary pivotal movement of the ski brake arms.

Furthermore it will be understood that features may be provided on any of the base plate, the heel plate or the ski brake, or a combination thereof to locate the ski brake against undue transverse movement.

I claim:

1. A ski brake arrangement comprising a ski brake having at least one brake arm, said ski brake being detachably associated with a base plate of a ski binding; a second plate having upper surface means adapted in operation to support a part of the sole of a ski boot, said second plate being connectable to and detachably associated with the base plate by means of cooperating clip elements provided respectively on said second plate and said base plate, and support means defined between said base plate and said second plate for detachably receiving pivot axle means associated with said brake arm with said pivot axle means disposed substantially parallel to the upper surface of said base plate and substantially transverse to the longitudinal direction thereof, whereby to support said brake arm for corresponding pivotal movement.

2. Ski brake arrangement according to claim 1, characterized in that said support means defined between the base plate and the second plate comprises at least one recess provided in one of the base plate and the second plate, said recess being open at one side to receive said pivot axle means, and the open side of said recess being closeable by means of the other respective one of said base plate and said second plate.

3. Ski brake arrangement according to claim 2 and in which said recess is provided in the base plate.

4. Ski brake arrangement according to claim 1 and in which the base plate comprises first and second parts, said first part of the base plate cooperating with the second plate to locate said pivot axle means and the first and second parts of the base plate being relatively axially displaceable, there being provided means for separately securing both parts of the base plate to the ski for allowing relative axial displacement of the two parts on bending of the ski.

5. Ski brake arrangement according to claim 1 and in which said support means comprises at least one claw like member open at its underside for receiving and locating said pivot axle means.

6. Ski brake arrangement according to claim 5 and in which said second plate is provided with at least one projection adapted to fit beneath said claw like member and engageable beneath said claw like member on axial movement of the second plate in the longitudinal direction of the ski, said projection cooperating with said claw like member to form said support means.

7. Ski brake arrangement according to claim 6 and in which said at least one projection is adapted in operation to abut said claw like member.

8. Ski brake arrangement according to claim 6 and in which said projection is adapted to abut in operation at least part of the base plate.

9. Ski brake arrangement according to claim 6 and in which said cooperating clip elements comprise a sprung latch projection on one of said base plate and said second plate and adapted to engage a latch recess provided in the other one of said base plate and said second plate.

10. Ski brake arrangement according to claim 9 and in which the said sprung latch projection is provided on said second plate and the said latch recess is provided on the base plate.

11. Ski brake arrangement according to claim 6 and in which said second plate includes at least one recess extending upwardly from the base of the second plate and subsequently forwardly through the second plate to define a recess for receiving said pivot axle means, and wherein the part of the second plate beneath said recess forms said projection.

12. Ski brake arrangement according to claim 6 and in which as seen from above, the second plate is generally of U-shaped form, the legs of the U extending behind said claw like member to either side of the base plate and said cooperating clip elements comprising latch projections provided on each leg and cooperating with latch recesses in said base plate.

13. Ski brake arrangement according to claim 6 and in which the second plate is provided with a depression in its upper surface for receiving an actuating part of the ski brake.

14. Ski brake arrangement according to claim 1 and in which the second plate is provided with a recess for receiving an actuating part of the ski brake.

15. Ski brake arrangement according to claim 1 and in which said support means comprises a recess provided in the front edge of the base plate, the second plate having recesses at the sides thereof, said recesses being adapted to clip over said pivot axle means to complete said support means.

16. Ski brake arrangement according to claim 15 and in which said cooperating clip elements comprise cooperating abutment members provided on said base plate and said second plate and an edge part of said base plate fitting into a latch recess on said second plate.

17. Ski brake arrangement according to claim 1 and in which said pivot axle means comprises first and second transverse axles and a torsionally loadable spring loop extending between said first and second axles and wherein both said axles are located by the support means.

18. Ski brake arrangement according to claim 1 and including means for axially locating said pivot axle means.

19. Ski brake arrangement according to claim 1 the second plate being provided with features cooperable with the base plate to prevent, in operation, relative sideways movement therebetween.

20. Ski brake arrangement in accordance with claim 1 and in which said pivot axle means comprises first and second transverse axles arranged transversely spaced apart on a common axis.

21. A ski brake arrangement in accordance with claim 1 and in which said second plate comprises a heel plate.

22. A ski brake arrangement in accordance with claim 1 and in which said base plate comprises the base plate of a heel binding.

23. A ski binding adapted to detachably receive a ski brake having at least one brake arm, the ski binding comprising a base plate, a second plate having surface means adapted in operation to support a part of the sole of a ski boot, said second plate being detachably associated with the base plate by means of cooperating clip elements provided respectively on said second plate and said base plate, and support means defined between said base plate and said second plate for detachably receiving pivot axle means associated with said brake arm with said pivot axle means disposed substantially parallel to the upper surface of said base plate and substantially transverse to the longitudinal direction thereof, whereby to support said brake arm for corresponding pivotal movement.

24. Ski binding according to claim 23, characterized in that said support means comprises at least one recess provided in one of the base plate and the second plate, said recess being open at one side to receive said pivot axle means and the open side of said recess being closeable by means of the other respective one of said base plate and said second plate.

25. Ski binding according to claim 23 and in which the base plate comprises first and second parts, said first part of the base plate cooperating with the second plate to locate said pivot axle means and the first and second parts of the base plate being relatively axially displaceable, there being provided means for separately securing both parts of the base plate to the ski for allowing relative axial displacement of the two parts on bending of the ski.

26. Ski binding according to claim 23 and in which said support means comprises at least one claw like member open at its underside for receiving and locating said pivot axle means.

27. Ski binding according to claim 26 and in which said second plate is provided with at least one projection adapted to fit beneath said claw like member and engageable beneath said claw like member on axial movement of the second plate in the longitudinal direction of the ski, said projection cooperating with said claw like member to form said support means.

28. Ski binding according to claim 27 and in which said second plate includes at least one recess extending upwardly from the base of the second plate and subsequently forwardly through the second plate to define a recess for receiving said pivot axle means and wherein the part of the second plate beneath said recess forms said projection.

29. Ski binding according to claim 26 and in which said cooperating clip elements comprise a sprung latch projection on one of said base plate and said second plate and adapted to engage a latch recess provided in the other one of said base plate and said second plate.

30. Ski binding according to claim 26 and in which, as seen from above, the second plate is generally of U-shaped form, the legs of the U extending behind said claw like member to either side of the base plate and said cooperating clip elements comprising latch projections provided on each leg and cooperating with latch recesses in said base plate.

31. Ski binding according to claim 26 and in which the second plate is provided with a depression in its upper surface for receiving an actuating part of the ski brake.

32. Ski binding according to claim 23 and in which the second plate is provided with a recess for receiving an actuating part of the ski brake.

33. Ski binding according to claim 23 and in which said support means comprises a recess provided in the front edge of the base plate, the second plate having recesses at the sides thereof, said recesses being adapted to clip over said pivot axle means whereby to complete said support means.

34. Ski binding according to claim 23 and in which said pivot axle means comprises first and second transverse axles and a torsionally loadable spring loop extending between said first and second axles and wherein both said axles are located by the support means.

35. Ski binding according to claim 23 and including means for axially locating said pivot axle means.

36. A ski binding in accordance with claim 23 and in which said pivot axle means comprises first and second transverse axles arranged transversely spaced apart on a common axis.

37. Ski binding in accordance with claim 27 and in which said second plate comprises a heel plate.

38. Ski binding in accordance with claim 23 and in which said ski binding comprises a heel binding.

* * * * *